US007513497B2

(12) United States Patent
Yonemoto

(10) Patent No.: US 7,513,497 B2
(45) Date of Patent: Apr. 7, 2009

(54) IMAGE FORMING APPARATUS AND SHEET FEEDING CASSETTE

(75) Inventor: Satoru Yonemoto, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 11/598,854

(22) Filed: Nov. 14, 2006

(65) Prior Publication Data

US 2007/0114713 A1 May 24, 2007

(30) Foreign Application Priority Data

Nov. 21, 2005 (JP) ..... 2005-335855

(51) Int. Cl.
*B65H 1/00* (2006.01)

(52) U.S. Cl. ..... 271/171

(58) Field of Classification Search ..... 271/171
See application file for complete search history.

(56) References Cited

U.S. PATENT DOCUMENTS 6,014,229 A * 1/2000 Yun ..... 358/449
6,454,254 B2 * 9/2002 Yamaguchi et al. ..... 271/171
6,581,926 B2 * 6/2003 Hsiao et al. ..... 271/171
6,805,345 B2 * 10/2004 Furukawa ..... 271/171
2003/0151188 A1 * 8/2003 Imahara ..... 271/171
2005/0051947 A1 * 3/2005 Furukawa ..... 271/171
2005/0062218 A1 * 3/2005 Murakami et al. ..... 271/171
2005/0133983 A1 * 6/2005 Jacobs et al. ..... 271/145
2005/0196212 A1 * 9/2005 Takemoto et al. ..... 399/393
2006/0244203 A1 * 11/2006 Kirby et al. ..... 271/162
2007/0138737 A1 * 6/2007 Yamada ..... 271/171

FOREIGN PATENT DOCUMENTS

JP 2003-212359 7/2003

* cited by examiner

*Primary Examiner*—Patrick H Mackey
*Assistant Examiner*—Howard Sanders
(74) *Attorney, Agent, or Firm*—Gerald E. Hespos; Anthony J. Casella

(57) ABSTRACT

An image forming apparatus includes: a main body for performing an image forming operation, and a sheet feeding cassette detachably mounted in the main body. The sheet feeding cassette includes: a pair of cursors spaced apart a predetermined distance and facing each other for regulating a size of a recording sheet stored in the sheet feeding cassette; a rack provided on each of the pair of cursors; a pinion provided between the racks and engaged with each of the racks; and a boss for supporting the pinion rotatably, the pair of cursors being movable in conjunction with each other by the way of racks and the pinion. Further, a rib is provided adjacently to the pinion at a predetermined space. The rib is operable to come in contact with the pinion to thereby keep the pinion from moving in a radial direction.

12 Claims, 5 Drawing Sheets

IMAGE FORMING APPARATUS AND SHEET FEEDING CASSETTE

BACKGROUND OF THE INVENTION

1. Field of the Invention

The present invention relates to an image forming apparatus including a sheet feeding cassette detachably mounted in a main body of the image forming apparatus and the sheet feeding cassette.

2. Description of the Related Art

Conventionally, an image forming apparatus including a center-registration type sheet feeding cassette adapted for storing a recording sheet to be supplied to a main body of the apparatus and detachably mounted in the main body (for example, refer to the Japanese Unexamined Patent Publication No. 2003-212359) is known.

Such conventional sheet feeding cassette as disclosed in the above-described patent document includes a pair of cursors for regulating a width size of a recording sheet stored in the sheet feeding cassette and is so constructed as to determine a position of the recording sheet in a width direction by moving the pair of cursors in conjunction with each other by the way of a rack provided on each of the pair of cursors and a pinion provided between the racks so as to be engaged with each of the racks. Further, the pinion is rotatably supported by a boss fixed on a bottom surface portion of the sheet feeding cassette.

However, in the sheet feeding cassette having the above-described construction, in the case where a disproportionate external force is applied to each cursor when a stack of recording sheets comes in contact with one of the cursors strongly at the time when the recording sheets are supplied to the sheet feeding cassette, the two disproportionate external forces transmitted to the pinion through the rack connected to each cursor urge the pinion to move in a radial direction. Accordingly, a load is applied to the pinion and the boss supporting the pinion and causes a problem that the boss and the pinion are damaged.

Especially, in an image forming apparatus which is so constructed that a sheet feeding direction of a recording sheet from the sheet feeding cassette to the main body is substantially perpendicular to an insertion and withdrawal direction of the sheet feeding cassette with respect to the main body, a pair of cursors face each other in the insertion and withdrawal direction and a cursor located at a near side in the insertion direction is generally fixed by a stopper member and the like at a predetermined position based on a size of a recording sheet to be stored in the sheet feeding cassette. Accordingly, at the time when the sheet feeding cassette is mounted in the image forming apparatus, a great impact force (external force) generated by an inertial force of the recording sheet to be stored in the sheet feeding cassette is applied to the cursor positioned at a back side in the insertion direction. Accordingly, since an excessively great load is applied to the pinion and the boss supporting the pinion, the above-described problem that the boss and the pinion is broken becomes more apparent.

SUMMARY OF THE INVENTION

The present invention was made to solve such problems as described above, and its object is to provide an image forming apparatus capable of preventing components of the sheet feeding cassette from being broken and a sheet feeding cassette.

An image forming apparatus according to one aspect of the present invention for achieving the object comprises: a main body for performing an image forming operation; a sheet feeding cassette detachably mounted in the main body, the sheet feeding cassette including: a pair of cursors spaced apart a predetermined distance and facing each other for regulating a size of a recording sheet stored in the sheet feeding cassette; a rack provided on each of the pair of cursors; a pinion provided between the racks and engaged with each of the racks; and a boss for supporting the pinion rotatably, the pair of cursors being movable in conjunction with each other by the way of the racks and the pinion; and a rib provided adjacently to the pinion at a predetermined space, the rib being operable to come in contact with the pinion to thereby keep the pinion from moving in a radial direction.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS

Hereinafter, an embodiment of the present invention is described with reference to the drawings.

Figure 1:
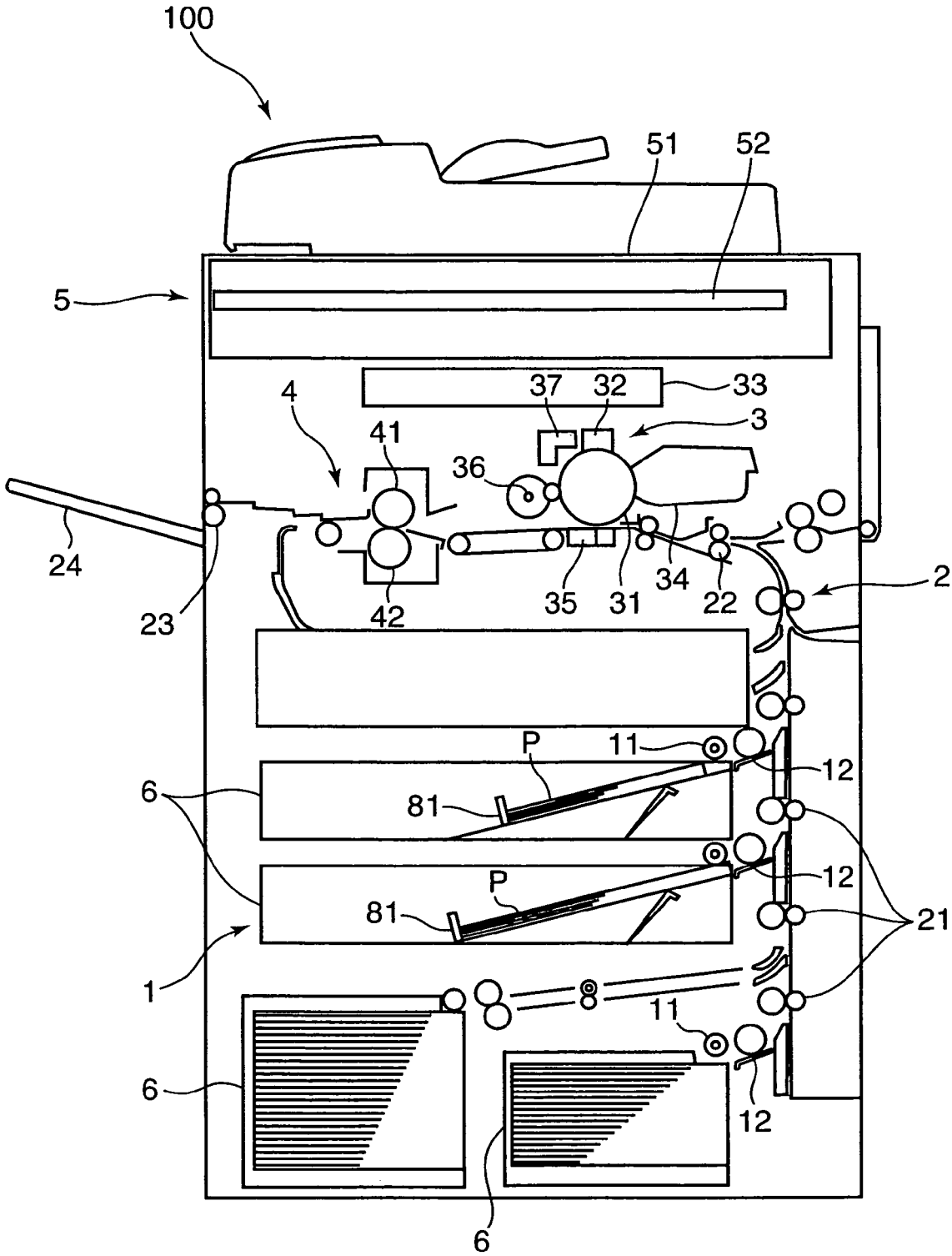
FIG. 1 is a sectional view for describing an overall construction of a copying machine according to an embodiment of the present invention.

FIG. 1 is a sectional view for describing an overall construction of a copying machine according to an embodiment of the present invention. FIGS. 2 to 5 are views for describing relevant parts of the sheet feeding cassette of the copying machine shown in FIG. 1. Arrows F and R in FIGS. 2 to 4 respectively show a front side and a rear side of the machine at the time when the sheet feeding cassette is mounted in the copying machine. At first, an overall construction of a copying machine 100 according to an embodiment of the present invention is described with reference to FIG. 1.

The copying machine 100 according to the embodiment is a center-registration type copying machine and includes a sheet feeding section 1, a sheet conveying section 2, an image forming section 3, a fixing section 4 and an image reading section 5. The sheet feeding section 1 is provided in a lower portion of a main body of the machine. The sheet conveying section 2 is provided on a side and upper side of the sheet feeding section 1. The image forming section 3 is provided on an upper side of the sheet conveying section 2. The fixing section 4 is provided on downstream in a sheet conveying direction from the image forming section 3. The image reading section 5 is provided on an upper side of the image forming section 3 and the fixing section 4 and includes an optical member and the like.

The sheet feeding section 1 includes a plurality of sheet feeding cassettes 6 detachably mounted in the main body. A rotational operation of a sheet feeding roller 11 having a circular arc-shaped peripheral portion is applied with respect to a stack of recording sheets P placed on the sheet feeding cassette 6. Accordingly, the recording sheets P are sent out toward an outlet side (the right side in FIG. 1) of the sheet feeding cassette 6. Further, the recording sheet P is separated by a separating portion 12 provided in an upper right end portion of each sheet feeding cassette 6. Accordingly, the recording sheet P placed at the uppermost position of the stack is assuredly supplied to the sheet conveying section 2 one after another. It should be noted that the copying machine 100 is so constructed that an insertion and withdrawal direction of the sheet feeding cassette 6 with respect to the main body is set to be a direction substantially perpendicular (a direction perpendicular to a sheet of FIG. 1) to the sheet feeding direction of the recording sheet P from the sheet feeding cassette 6 to the main body.

The sheet conveying section 2 includes a pair of conveying rollers 21, a pair of registration rollers 22 and a pair of discharging rollers 23 and conveys the recording sheet P from the sheet feeding section 1 to a discharging tray 24. The recording sheet P supplied from the sheet feeding section 1 is conveyed to the image forming section 3 by the pair of conveying rollers 21 and the pair of registration rollers 22. Further, the recording sheet P on which an image forming is applied in the image forming section 3 and the fixing section 4 is discharged onto the discharging tray 24 by the pair of discharging rollers 23.

The image forming section 3 is adapted for forming a predetermined toner image on the recording sheet P by an electrophotographic processing and includes a photoconductive drum 31, a charging unit 32, an exposing unit 33, a developing unit 34, a transferring unit 35, a cleaner 36 and an electric charge removing unit 37. The photoconductive drum 31 is rotatably supported and has a photoconductivity. The charging unit 32 is provided in a periphery of the photoconductive drum 31.

The charging unit 32 includes a charging wire to which a high voltage is applied. A corona discharging from the charging wire provides a predetermined electric potential to a surface of the photoconductive drum 31. The exposing unit 33 irradiates a laser light ray emitted from a laser emitting device based on an image data of a document read in the image reading section 5 described hereinafter to the photoconductive drum 31 through a polygon mirror and a reflective mirror. Accordingly, the exposing unit 33 selectively attenuates an electric potential of a surface of the photoconductive drum 31 and forms an electrostatic latent image on the surface of the photoconductive drum 31. The developing unit 34 is adapted for developing the electrostatic latent image by toner particles to thereby form a toner image on the surface of the photoconductive drum 31.

The transferring unit 35 is adapted for transferring a toner image formed on the surface of the photoconductive drum 31 to the recording sheet P. In the copying machine 100, the transferring unit 35 is constructed by a transferring roller located a predetermined distance apart from the photoconductive drum 31. The cleaner 36 is adapted for removing toner particles resided on the surface of the photoconductive drum 31 after the transferring process. The electric charge removing unit 37 removes an electric charge resided on the surface of the photoconductive drum 31.

The fixing section 4 is provided on downstream in a sheet conveying direction from the image forming section 3. In the fixing section 4, the recording sheet P on which a toner image is transferred in the image forming section 3 is nipped and heated by a heating roller 41 and a pressing roller 42 so as to fix the toner image on the recording sheet P.

The image reading section 5 irradiates a light ray from the exposure lamp to a document which is placed on a contact glass 51 and leads a reflected light ray through a reflective mirror to a photoelectric converter including a CCD line sensor and the like so as to read image information of the document. The exposure lamp and the reflective light constitute a scanning operating section, and the scanning operating section performs a moving operation at a predetermined speed in a moving area 52 extending in a leftward and rightward direction in FIG. 1. Accordingly, a whole surface of the document placed on the contact glass 51 is scanned, and an image of a whole surface of the document can be read out.

Next, a construction of the sheet feeding cassette 6 is described in detail with reference to the FIGS. 2 to 5. The sheet feeding cassette 6 is constructed by placing and attaching a sheet feeding tray 62 on a tray frame 61. The tray frame 61 is detachably attached to the main body through a slide mechanism 61*a*. The slide mechanism 61*a* is slidably moved by pulling a handle formed in a front face cover 61*b* of the tray frame 61 so that the sheet feeding cassette 6 can be withdrawn toward a near side. A user performs feeding and the like of the recording sheet with respect to the sheet feeding tray 62 of the sheet feeding cassette 6 which is withdrawn in such a manner as described above.

Figure 2:
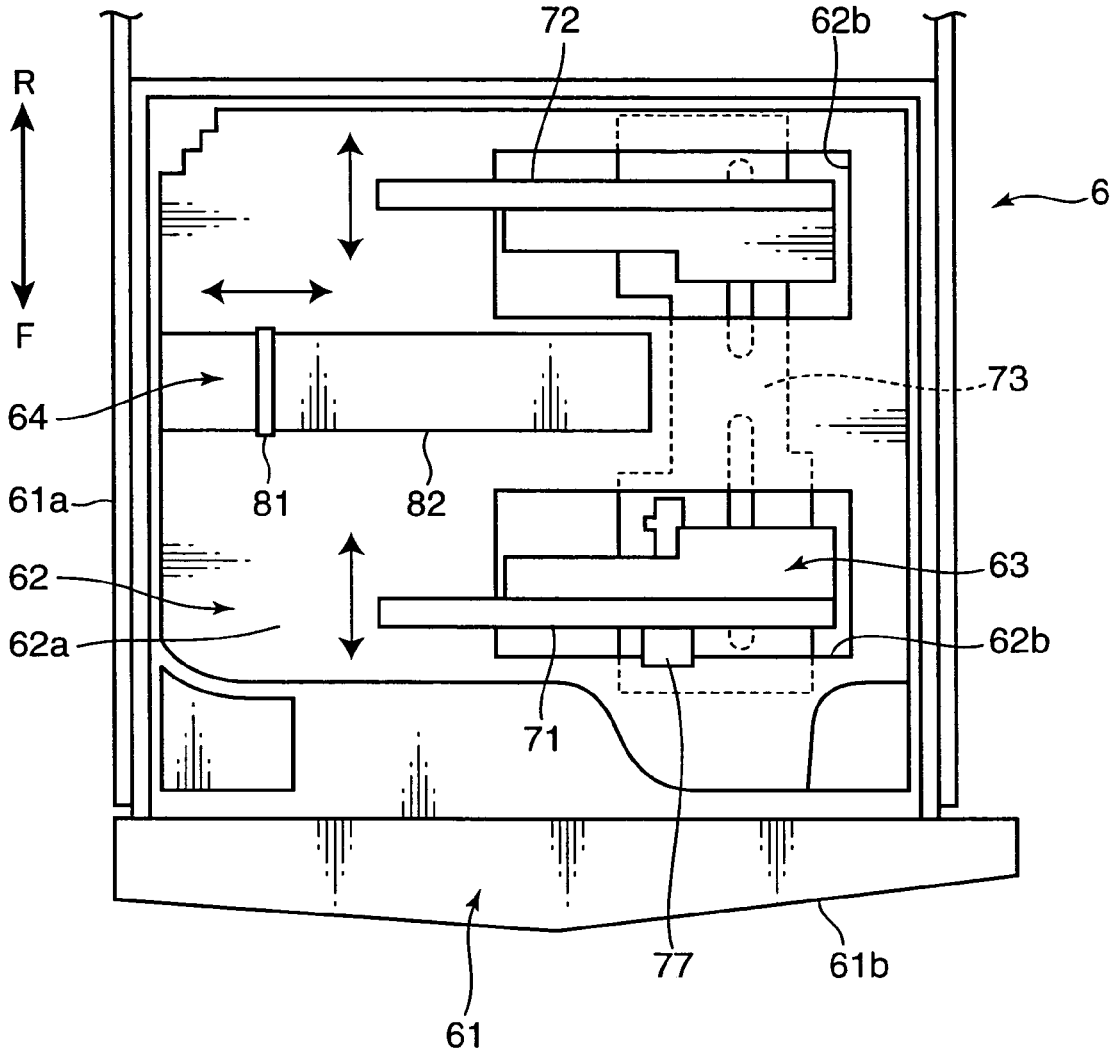
FIG. 2 is a plan view for describing a construction of a sheet feeding cassette of the copying machine shown in FIG. 1.
Figure 3:
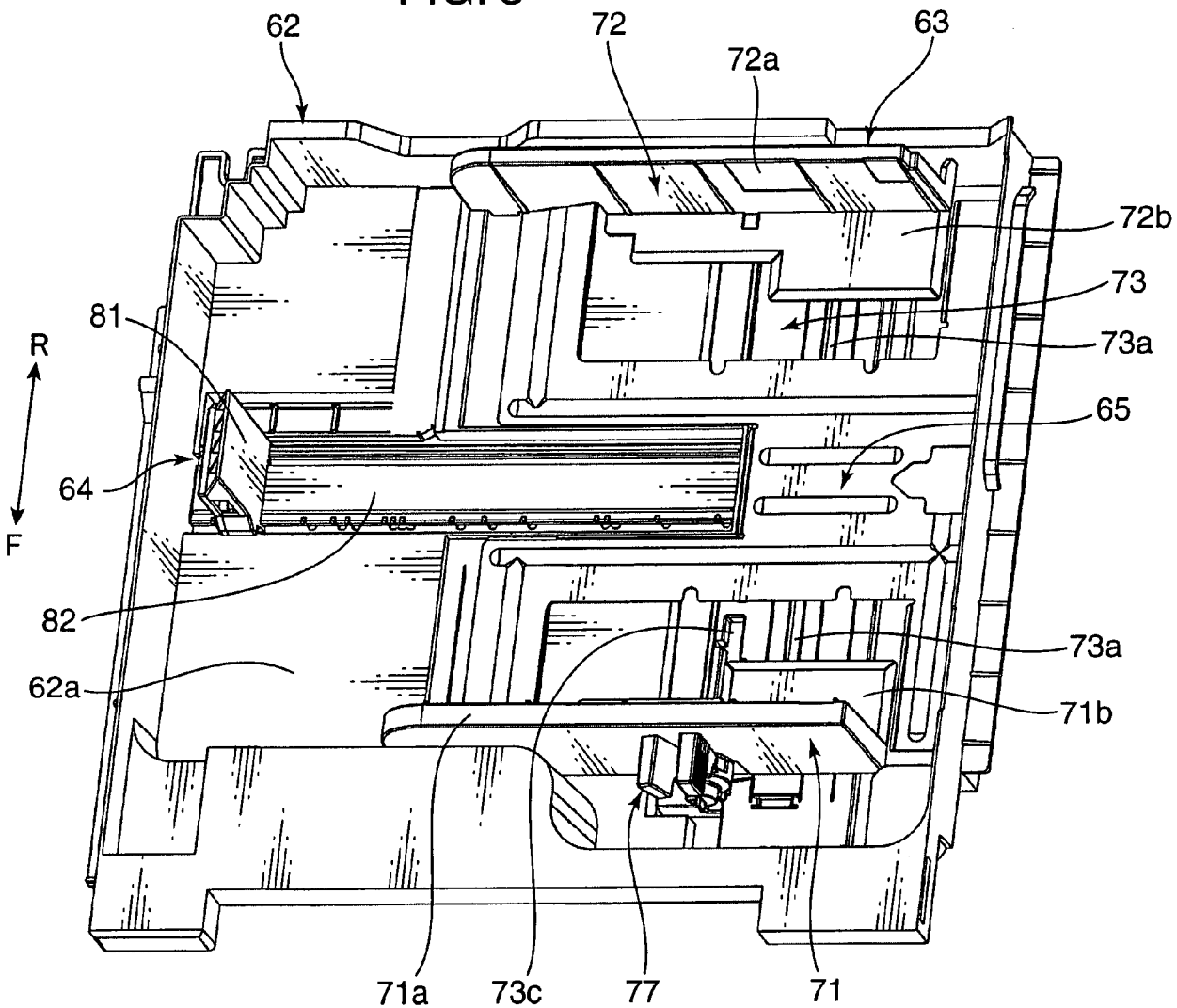
FIG. 3 is a perspective view of a sheet feeding tray of the sheet feeding cassette shown in FIG. 2.

As shown in FIG. 2, the sheet feeding tray 62 includes a recessed sheet storing portion 62*a* capable of stacking and storing the recording sheet P. On a bottom portion of the sheet storing portion 62*a*, two openings 62*b* are provided. The openings 62*b* are provided for slidably moving a pair of width cursors 71, 72 in the sheet storing portion 62*a* with respect to a width cursor rail member 73 described hereinafter provided in a lower face side of the sheet feeding tray 62.

Further, the sheet feeding tray 62 is provided with a sheet width regulating mechanism 63, a sheet length regulating mechanism 64 and a lifting member 65. The sheet width regulating mechanism 63 and the sheet length regulating mechanism 64 are adapted for regulating a predetermined sheet position corresponding to a size of the recording sheet P which is to be stored in the sheet storing portion 62*a*. The lifting member 65 is adapted for lifting a front end portion of the recording sheet P in a sheet feeding direction and makes it come in contact with the sheet feeding roller 11.

The sheet width regulating mechanism 63 includes a pair of width cursors 71, 72 (a front face side width cursor 71 and a rear face side width cursor 72), a width cursor rail member 73, racks 74, 75, a pinion 76 and a stopper member 77. The pair of cursors 71, 72 are adapted for regulating a width direction of the recording sheet P. The width cursor rail member 73 is adapted for slidably supporting the pair of width cursors 71, 72. The racks 74, 75 and the pinion 76 are adapted for making the pair of width cursors 71, 72 move in conjunction with each other. The stopper member 77 is attached to the front face width cursor 71 and regulates a position of the front face side width cursor 71 with respect to the width cursor rail member 73. The front face side width cursor 71 and the rear face side width cursor 72 are examples of "cursors" in the present invention, and the width cursor rail member 73 is an example of "a rail member" in the present invention.

The pair of width cursors 71 and 72 are slidable in a width direction of the recording sheet P on the width cursor rail member 73 and moves in conjunction with each other by racks 74, 75 and the pinion 76 to adjust a space (width) between the cursors 71, 72 to be wider or narrower.

The width cursor 71 includes a plate-like vertical portion 71*a* and a plate-like horizontal portion 71*b*. The width cursor 72 includes a plate-like vertical portion 72*a* and a plate-like horizontal portion 72*b*. The vertical portions 71*a*, 72*a* extend vertically. The horizontal portions 71*b*, 72*b* are integrally formed with the respective vertical portions 71*a*, 72*a*. The width direction of the recording sheet P is regulated by the vertical portions 71*a*, 72*a*. A vicinity of side edge portions of the recording sheet P are supported from a lower side by the horizontal portions 71*b*, 72*b* so that the recording sheet P can be stored in the state of being trimmed.

Figure 4:
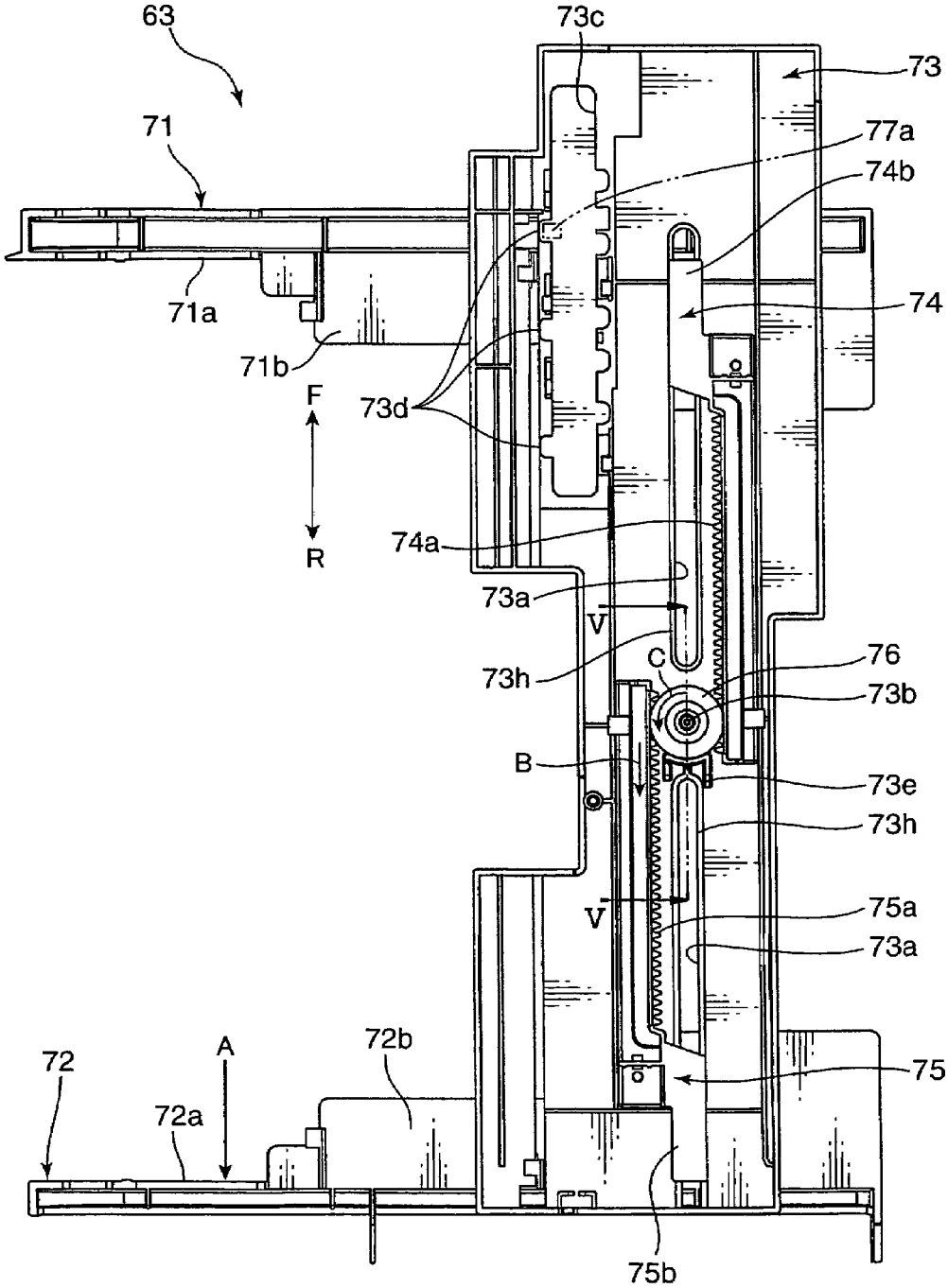
FIG. 4 is a bottom view for describing a construction of a sheet width regulating mechanism of the sheet feeding cassette shown in FIG. 3.

As shown in FIG. 4, the pair of racks 74, 75 are provided in a lower surface side of the width cursor member 73 such that respective rack teeth portions 74*a*, 75*a* face each other. The pair of racks 74, 75 correspond to a pair of guide elongate holes 73*a* formed in the width cursor rail member 73 and are attached to respective width cursors 71, 72 by attaching members 74*b*, 75*b*. Further, in a central portion of the width cursor rail member 73, the pinion 76 which engages with each of the rack teeth portions 74*a*, 75*a* is provided. The racks 74, 75 may be integrally formed with the respective width cursors 71, 72.

Figure 5:
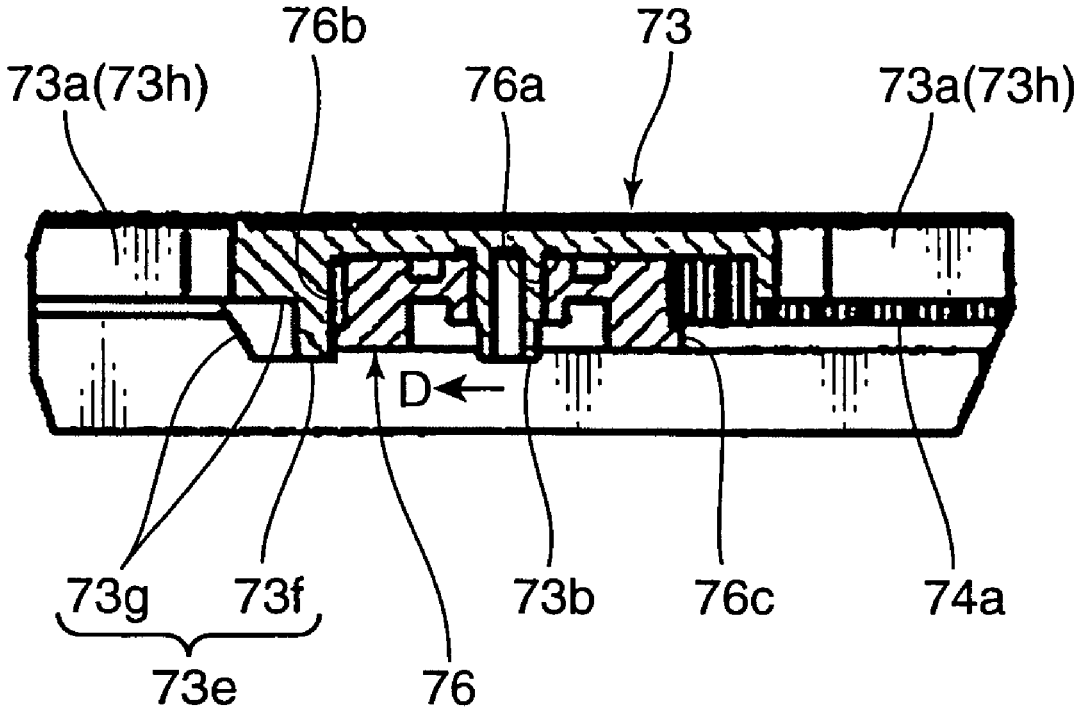
FIG. 5 is a sectional view taken along V-V line in FIG. 4.

As shown in FIG. 5, the pinion 76 includes pinion teeth member 76*b* engaging with the respective rack teeth portions 74*a*, 75*a* of the pair of racks 74, 75 facing each other and a flange 76*c* which is coaxially and integrally formed with the pinion teeth portion 76*b*. The flange portion 76*c* has a diameter larger than that of the pinion teeth portion 76*b*. A boss 73*b* integrally formed with a central portion of the width cursor rail member 73 is inserted to a boss insertion hole 76*a* of the pinion 76. Accordingly, the pinion 76 is supported rotatably about the boss 73*b*. The flange portion 76*c* keeps each of the racks 74, 75 engaged with the pinion teeth portion 76*b* from moving out.

Further, an opening 73*c* is formed in the width cursor rail member 73 at a part close to a front face side of the machine. The opening 73*c* is adapted for moving a claw 77*a* of the stopper member 77 (refer to FIG. 4) attached to the front face side width cursor 71 in accordance with a sliding movement of the front face width cursor 71. The opening 73*c* is formed with a plurality of notches 73*d* which are engaged with the claw 77*a*. The front face side width cursor 71 can be held at a position corresponding to a size of the recording sheet P stored in the sheet feeding tray 62 by engaging the claw 77*a* at the predetermined notch 73*d*.

Herein, in the present embodiment, as shown in FIG. 4, a rib 73*e* is integrally formed on the width cursor rail member 73 at a position between the pinion 76 provided on the lower surface of the width cursor rail member 73 and the guide elongate hole 73*a* in a rear surface side of the machine. The rib 73*e* includes a receiving portion 73*f* and a reinforcing portion 73*g*. The receiving portion 73*f* is formed to have a shape of circle having a curvature radius which is substantially the same as a curvature radius of an outer surface of the flange portion 76*c* of the pinion 76 and arranged so as to have a small gap with respect to the outer surface of the flange portion 76*c*. When an external force is applied to the pinion 76 and a load is applied in a direction of an arrow D in FIG. 5, the receiving portion 73*f* of the rib 73*e* comes in contact with the flange portion 76*c* of the pinion 76.

The reinforcing portion 73*g* has a function to reinforce the receiving portion 73*f* and extends outwardly from opposite ends and center of the arc toward the outer side of the arc so as to be apart from the pinion 76. The reinforcing member 73*g* extending from the center of the arc is continuously attached to a flange-shaped standing portion 73*h* formed in an edge of the guide elongate hole 73*a*.

According to an interconnecting mechanism of the sheet width regulating mechanism 63, a drive force generated by moving one width cursor (e.g. front face side width cursor 71) is transmitted to the pinion teeth 76*b* through the rack teeth 74*b* of the rack 74 connected to the width cursor 71. Accordingly, the pinion 76 rotates about the boss 73*b*. Further, the drive force generated by the rotation is transmitted to the rack 75 through the rack teeth 75*a* engaged with the pinion 76. Accordingly, the rack 75 moves the same distance in a direction opposite to the direction of movement of the rack 74. Consequently, the other width cursor (rear face width cursor 72) moves the same distance in the opposite direction by operating only one width cursor (front face width cursor 71).

The sheet length regulating mechanism 64 includes a cursor 81 for regulating a length direction of the recording sheet P and a cursor rail member 82 for supporting the cursor 81. The length cursor 81 is slidable in a length direction of the recording sheet P on the cursor rail member 82 and regulates a sheet position of the recording sheet P in the length direction by the way of the length cursor 81 and an inner wall surface of the sheet feeding tray 62 (a right side inner wall surface in FIG. 2).

The lifting member 65 is formed to have a plate-like shape capable of covering substantially a right half of the bottom surface of the sheet feeding tray 62 without interfering the sliding movement of each of the cursors 71, 72, 81. Opposite ends in the left side of the lifting member 65 are axially supported by unillustrated pins which are attached to a side surface portion of the sheet feeding tray. Accordingly, the right side of the lifting member 65 can be stood with respect to the bottom surface of the sheet feeding tray 62.

In the present embodiment, as described above, the sheet feeding direction of the recording sheet P from the sheet feeding cassette 6 to the main body is set to be substantially perpendicular to the insertion and withdrawal direction of the sheet feeding cassette 6 with respect to the main body. Accordingly, when the sheet feeding cassette 6 is mounted in the main body of the apparatus, a great impact force generated by an inertial force of the recording sheet P to be stored in the sheet feeding cassette 6 (refer to the arrow A in FIG. 4) is applied to the rear face side width cursor 72 positioned at a rear side in the insertion direction of the sheet feeding tray 62.

Further, the front face side width cursor 71 positioned at a front side in the insertion direction of the sheet feeding tray 62 is fixed by the stopper member 77 at a predetermined position based on a size of the recording sheet to be stored in the sheet feeding tray 62. Accordingly, at the time of mounting the sheet feeding cassette 6, in the sheet width regulating mechanism 63, the other rack 75 is moved in a direction of an arrow B while the one rack 74 is fixed. Consequently, an exterior force which moves the pinion 76 engaged with the racks 74, 75 on the rack teeth portion 74*a* in the direction of the arrow D in FIG. 5 while rotating the pinion 76 in the direction of the arrow C is applied.

However, according to the sheet feeding cassette 6 in the present embodiment, in the state where the external force described above is applied to the pinion 76 and moves the pinion 76 in the radial direction (the direction of the arrow D), the rib 73*e* comes in contact with the pinion 76 to thereby regulate the movement of the pinion in the radial direction. Accordingly, by making the external force applied to the pinion 76 be transmitted to the rib 73*e*, a load transmitted to the boss 73*b* which axially supports the pinion 76 can be reduced sufficiently. Consequently, a breakage of the boss 73*b* and the pinion 76 can be prevented sufficiently.

In the present embodiment, since the rib 73*e* comes in contact with the flange portion 76*c* of the pinion 76, a deformation or breakage of teeth tops of the pinion teeth portion 76*b* can be prevented by the contact with the rib 73*e*.

Further, by making the receiving portion 73*f* of the rib 73*e* having substantially the same curvature radius as that of the outer surface of the flange portion 76*c* of the pinion 76 come in contact with the outer surface of the flange portion 76*c* of the pinion 76, the load transmitted from the pinion 76 to the rib 73*e* can be easily dissipated on a receiving surface of the receiving portion 73*f* of the rib 73*e*.

Further, by integrally forming the rib 73*e* with the width cursor rail member 73 integrally formed with the boss 73*b*, a positional relationship between the respective each boss 73*b* integrally formed with the width cursor rail member 73 can be easily maintained. Accordingly, in the state where a predetermined load is applied to the boss 73*b* due to a movement of the pinion 76, the rib 73*e* assuredly comes into contact with the pinion 76 so that a breakage of the boss 73*b* can be prevented. Further, an increase in number of components can be suppressed by the integral formation.

It should be noted that the disclosed embodiment is exemplification in all of the points and should not be considered restrictive. A scope of the present invention is defined not in the above-described description of the embodiment but in the claims and includes meanings equivalent to the claims and all of the modification within the scope.

For example, in the above-described embodiment, an example of applying the present invention to a copying machine which is an example of an image forming apparatus is described. The present invention is not limited to this. The invention can be also applied to a printer and a facsimile machine other than a copying machine and to a composite machine including functions of the printer and the facsimile machine.

Further, in the above-described embodiment, an example of applying the present invention to a copying machine having a construction in which an insertion and withdrawal direction of the sheet feeding cassette is substantially perpendicular to the sheet feeding direction with respect to the apparatus main body is described. The present invention is not limited to this. The present invention can be also applied to a copying machine having a construction in which an insertion and withdrawal direction of the sheet feeding cassette is the same as the sheet feeding direction with respect to the apparatus main body, e.g. a copying machine having a construction in which the sheet feeding cassette is withdrawn from the right side in FIG. 1. In this case, in addition to providing a rib in a rear surface side of the pinion, it is preferable to provide a rib having the same construction in a front face side of the pinion. Accordingly, for example, even if a bundle of recording sheets strongly comes in contact with any one of the cursors at the time when the recording sheets are fed to the sheet feeding cassette and an uneven external force is applied thereto so that an external force which moves the pinion in a radial direction is applied to the pinion, the rib comes in contact with the pinion and restricts a movement of the pinion in the radial direction. Accordingly, a load transmitted to the boss which axially supports the pinion can be reduced. Consequently, similarly to the above-described embodiment, a breakage of the boss and the pinion can be prevented.

The specific embodiment described above includes the invention including the following construction.

An image forming apparatus according to one aspect of the present invention comprises: a main body for performing an image forming operation; a sheet feeding cassette detachably mounted in the main body, the sheet feeding cassette including: a pair of cursors spaced apart a predetermined distance and facing each other for regulating a size of a recording sheet stored in the sheet feeding cassette; a rack provided on each of the pair of cursors; a pinion provided between the racks and engaged with each of the racks; and a boss for supporting the pinion rotatably, the pair of cursors being movable in conjunction with each other by the way of the racks and the pinion; and a rib provided adjacently to the pinion at a predetermined space, the rib being operable to come in contact with the pinion to thereby keep the pinion from moving in a radial direction.

According to the construction, the rib is provided for keeping the pinion from moving in the radial direction so that the rib comes in contact with the pinion and keeps the pinion from moving in the radial direction in the case where a load which moves the pinion in the radial direction is applied to the pinion. Accordingly, an external force applied to the pinion can be transmitted to the rib. Accordingly, a load transmitted to the boss axially supporting the pinion can be reduced. Consequently, a breakage of the boss and the pinion can be prevented. As an example of the case where an external force which tends to move the pinion in the radial direction, there is a case where a stack of recording sheets comes in contact with one cursor at the time when the recording sheets are fed to the sheet feeding cassette so that an uneven external force is applied.

In the above-described construction, it is preferable that: the pair of cursors face each other at a predetermined space in an insertion and withdrawal direction and are adapted for regulating a size in the insertion and withdrawal direction for recording sheets to be stored in the sheet feeding cassette; one of the racks extends in the insertion and withdrawal direction from the cursor on which the one rack is provided to the opposite cursor; and the rib is provided so as to come in contact with a rear part of the pinion in the insertion direction of the sheet feeding cassette to keep the pinion from moving in the insertion direction.

In this case, in the image forming apparatus having a construction in which the sheet feeding direction of the recording sheet from the sheet feeding cassette to the apparatus main body is perpendicular to the insertion and withdrawal direction of the sheet feeding cassette with respect to the apparatus main body, a breakage of the boss and the pinion can be prevented sufficiently. Namely, in the image forming apparatus having a construction in which the sheet feeding direction to the apparatus main body is perpendicular to the insertion and withdrawal direction of the sheet feeding cassette, a great impact force due to an inertial force of the recording sheet stored in the sheet feeding cassette is applied to the cursor positioned at a rear part in the insertion direction of the sheet feeding cassette at the time when the sheet feeding cassette is mounted to the image forming apparatus so that a great external force is applied to the pinion. However, by applying the construction described above, the rib comes in contact with the pinion to restrict the movement of the pinion in the radial direction. Accordingly, a load transmitted to the boss supporting the pinion can be reduced sufficiently. Consequently, as described above, a breakage of the boss and the pinion can be prevented sufficiently.

In the above-described construction, it is preferable that: the pinion includes teeth arranged in a circle and engaged with the racks; and the rib is operable to come in contact with the pinion without coming in contact with the teeth to thereby keep the pinion from moving. According to the construction, since the rib comes in contact with the pinion without coming in contact with the teeth, a deformation and breakage of teeth top of the pinion teeth by coming in contact with the rib can be prevented.

In this case, it is preferable that: the pinion includes an annular flange which is coaxial with the circularly arranged teeth and has a diameter larger than the circularly arranged teeth; the rib is provided adjacently to the annular flange at a predetermined space from an outer peripheral surface of the annular flange and includes a circular receiving portion operable to come in contact with the outer peripheral surface of the annular flange to keep the pinion from moving; and a pinion receiving surface of the circular receiving portion has a curvature radius which is substantially the same as a curvature radius of the outer peripheral surface of the annular flange.

By so constructing the flange portion coming in contact with the rib to have a diameter larger than the pinion teeth, the rib is assuredly prevented from coming in contact with the pinion teeth. Further, by making the receiving portion of the rib having a curvature radius be the same as that of an outer surface of the flange portion of the pinion, a load transmitted from the pinion to the rib can be easily dissipated on the receiving surface of the receiving portion of the rib.

Further, in the above-described construction, it is preferable that: a rail member which is provided in the sheet feeding cassette for movably supporting the pair of cursors; and the boss is integrally formed on the rail member, wherein the rib is integrally formed on the rail member.

According to the construction, a positional relationship between each boss integrally formed with the rail member and the rib can be easily maintained. Accordingly, a breakage of the boss can be prevented by making the rib assuredly come in contact with the pinion in the state where a predetermined load is applied to the boss due to a movement of the pinion. Further, increase in the number of parts can be suppressed by the integral formation.

This application is based on patent application No. 2005-335855 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a main body for performing an image forming operation;

a sheet feeding cassette detachably mounted in the main body, the sheet feeding cassette including:

a pair of cursors spaced apart a predetermined distance and facing each other for regulating a position of a recording sheet stored in the sheet feeding cassette;

a rack provided on each of the pair of cursors;

a pinion provided between the racks and having an outer peripheral surface and being formed with teeth arranged in a circle for engagement with each of the racks, the pinion including an annular flange that is coaxial with the circularly arranged teeth and has a diameter larger than the circularly arranged teeth; and a boss for supporting the pinion rotatably, the pair of cursors being movable in conjunction with each other by the way of the racks and the pinion; and a rib provided adjacently to the annular flange of the pinion at a predetermined space from an outer peripheral surface of the annular flange in an insertion direction of the sheet feeding cassette, the rib including a circular receiving portion disposed to contact the outer peripheral surface of the annular flange in the insertion direction of the sheet feeding cassette to keen the pinion from moving in a radial direction, a pinion receiving surface of the circular receiving portion having a curvature radius that is substantially the same as a curvature radius of the outer peripheral surface of the annular flange.

2. An image forming apparatus according to claim 1, wherein:

the pair of cursors face each other at a predetermined space in an insertion and withdrawal direction of the sheet feeding cassette relative to the main body and are adapted for regulating in the insertion and withdrawal direction the position of the recording sheets to be stored in the sheet feeding cassette;

one of the racks extends in the insertion and withdrawal direction from the cursor on which the one rack is provided to the opposite cursor; and the rib is provided so as to come in contact with a rear part of the pinion in the insertion direction of the sheet feeding cassette to keep the pinion from moving in the insertion direction.

3. An image forming apparatus according to claim 1, further comprising:

a rail member provided in the sheet feeding cassette for movably supporting the pair of cursors, the boss being integrally formed on the rail member, wherein the rib is integrally formed on the rail member.

4. A sheet feeding cassette detachably mounted in a main body, comprising:

a pair of cursors spaced apart a predetermined distance and facing each other for regulating a position of a recording sheet stored in the sheet feeding cassette;

a rack provided on each of the pair of cursors;

a pinion provided between the racks and having an outer peripheral surface and formed with teeth arranged in a circle for engagement with each of the racks, the pinion including an annular flange that is coaxial with the circularly arranged teeth and has a diameter larger than the circularly arranged teeth;

a boss for supporting the pinion rotatably; and a rib provided adjacently to the annular flange of the pinion at a predetermined space, from an outer peripheral surface of the annular flange in an insertion direction of the sheet feeding cassette, the rib including a circular receiving portion disposed to contact the outer peripheral surface of the annular flange in the insertion direction of the sheet feeding cassette to keep the pinion from moving in a radial direction; a pinion receiving surface of the circular receiving portion having a curvature radius that is substantially the same as a curvature radius of the outer peripheral surface of the annular flange, wherein:

the pair of cursors are movable in conjunction with each other by the way of the racks and the pinion.

5. A sheet feeding cassette according to claim 4, wherein:

the pair of cursors face each other at a predetermined space in an insertion and withdrawal direction and are adapted for regulating in the insertion and withdrawal direction the position of the recording sheets to be stored in the sheet feeding cassette;

one of the racks extends in the insertion and withdrawal direction from the cursor on which the one rack is provided to the opposite cursor; and the rib is provided so as to come in contact with a rear part of the pinion in the insertion direction of the sheet feeding cassette to keep the pinion from moving in the insertion direction.

6. A sheet feeding cassette according to claim 4, further comprising:

the rail member provided in the sheet feeding cassette for movably supporting the pair of cursors, the boss being integrally formed on the rail member, wherein the rib is integrally formed on the rail member.

7. An image forming apparatus according to claim 1, wherein the pinion includes a central aperture and wherein the boss extends through the central aperture of the pinion for supporting the pinion rotatably.

8. An image forming apparatus according to claim 1, wherein the outer peripheral surface of the pinion is disposed radially outwardly from the boss and radially inwardly from the rib.

9. An image forming apparatus according to claim 8, wherein the outer peripheral surface of the pinion that is contacted by the rib defines a radially outermost part of the pinion.

10. An image forming apparatus according to claim 4, wherein the pinion includes a central aperture and wherein the boss extends through the central aperture of the pinion for supporting the pinion rotatably.

11. An image forming apparatus according to claim 4, wherein the outer peripheral surface of the pinion is disposed radially outwardly from the boss and radially inwardly from the rib.

12. An image forming apparatus according to claim 11, wherein the outer peripheral surface of the pinion that is contacted by the rib defines a radially outermost part of the pinion.

* * * * *